US006350224B1

(12) United States Patent
Cordaro et al.

(10) Patent No.: US 6,350,224 B1
(45) Date of Patent: Feb. 26, 2002

(54) CENTRIFUGAL UNBALANCE DETECTION SYSTEM

(75) Inventors: Joseph V. Cordaro, Martinez, GA (US); George Reeves, Graniteville; Michael Mets, Aiken, both of SC (US)

(73) Assignee: Westinghouse Savannah River Company, LLC, Aiken, SC (US)

( * ) Notice: Subject to any disclaimer, the term of this patent is extended or adjusted under 35 U.S.C. 154(b) by 0 days.

(21) Appl. No.: 09/617,410

(22) Filed: Jul. 17, 2000

(51) Int. Cl.[7] ..... B04B 13/00

(52) U.S. Cl. ..... 494/7; 494/10; 494/37; 494/82; 73/462; 702/56

(58) Field of Search ..... 494/1, 7, 9–12, 494/16, 37, 82, 84; 210/85, 144, 363; 318/460, 470; 68/23.1, 23.3, 12.06; 73/66, 457, 460, 462; 702/56

(56) References Cited

U.S. PATENT DOCUMENTS

| | | | | |
|---|---|---|---|---|
| 2,666,572 | A | * | 1/1954 | Pickels |
| 2,895,023 | A | * | 7/1959 | Blum |
| 3,101,322 | A | * | 8/1963 | Stallman et al. |
| 3,226,016 | A | * | 12/1965 | Couper et al. |
| 3,422,957 | A | | 1/1969 | Fosler ..... 210/144 |
| 3,436,637 | A | * | 4/1969 | Ehret |
| 3,636,545 | A | * | 1/1972 | Boyd et al. |
| 3,676,723 | A | * | 7/1972 | Drucker |
| 3,699,287 | A | * | 10/1972 | Stahl et al. |
| 3,921,047 | A | * | 11/1975 | Carter et al. |
| 4,028,524 | A | * | 6/1977 | Moll et al. |
| 4,060,716 | A | * | 11/1977 | Pekrul et al. |
| 4,070,290 | A | * | 1/1978 | Crosby |
| 4,096,988 | A | * | 6/1978 | Scuricini |
| 4,099,667 | A | | 7/1978 | Uchida |
| 4,214,179 | A | | 7/1980 | Jacobson et al. |
| 4,491,019 | A | | 1/1985 | Wicki et al. ..... 73/457 |
| 4,551,715 | A | * | 11/1985 | Durbin |
| 4,700,117 | A | | 10/1987 | Giebeler et al. ..... 318/327 |
| 4,827,197 | A | * | 5/1989 | Giebeler |
| 4,910,502 | A | * | 3/1990 | Serveau et al. |
| 4,972,110 | A | * | 11/1990 | Gorodissky et al. |
| 5,160,876 | A | | 11/1992 | Niiani et al. ..... 318/460 |
| 5,235,864 | A | * | 8/1993 | Rosselli et al. |
| 5,342,280 | A | * | 8/1994 | Niinai et al. |
| 5,496,254 | A | | 3/1996 | Keller et al. ..... 494/7 |
| 5,649,893 | A | * | 7/1997 | Inaniwa et al. |
| 5,738,622 | A | | 4/1998 | Niiani et al. ..... 494/7 |
| 5,800,331 | A | | 9/1998 | Song ..... 494/7 |
| 5,857,955 | A | | 1/1999 | Phillips et al. ..... 494/5 |
| 5,879,279 | A | | 3/1999 | Berger et al. ..... 494/7 |
| 5,906,020 | A | | 5/1999 | Swint |
| 6,205,405 | B1 | * | 3/2001 | Pouvreau |

FOREIGN PATENT DOCUMENTS

| | | | |
|---|---|---|---|
| DE | 2358803 | * | 6/1975 |
| DE | 3742149 | * | 6/1989 |
| FR | 2306017 | * | 10/1976 |
| GB | 2146784 | * | 4/1985 |
| GB | 2221048 | * | 1/1990 |
| JP | 51-71570 | * | 6/1976 |
| SU | 937027 | * | 6/1982 |
| SU | 1287945 | * | 2/1987 |

* cited by examiner

*Primary Examiner*—Charles E. Cooley
(74) *Attorney, Agent, or Firm*—Dean W. Russell, Esq.; Kristin D. Mallatt, Esq.; Kilpatrick Stockton LLP

(57) ABSTRACT

A system consisting of an accelerometer sensor attached to a centrifuge enclosure for sensing vibrations and outputting a signal in the form of a sine wave with an amplitude and frequency that is passed through a pre-amp to convert it to a voltage signal, a low pass filter for removing extraneous noise, an A/D converter and a processor and algorithm for operating on the signal, whereby the algorithm interprets the amplitude and frequency associated with the signal and once an amplitude threshold has been exceeded the algorithm begins to count cycles during a predetermined time period and if a given number of complete cycles exceeds the frequency threshold during the predetermined time period, the system shuts down the centrifuge.

16 Claims, 3 Drawing Sheets

CENTRIFUGAL UNBALANCE DETECTION SYSTEM

The U.S. government has rights in this invention pursuant to contract number DE-AC09-96SR18500 between the U.S. Department of Energy and Westinghouse Savannah River Company.

FIELD OF THE INVENTION

This invention relates generally to systems and methods relating to centrifuges. More specifically, this invention is an improved control system for detecting imbalances in centrifuges.

BACKGROUND OF THE INVENTION

Centrifuge technology presents unique design criteria wherein precision control of the rotational operation of the centrifuge is required. Most centrifuge technology is used for biological and chemical experimental research, which uses centrifugation as their primary tool to achieve component separation and perform experimental assays. These types of centrifuges carry light payloads. However, another class of centrifuges exists for carrying larger payloads, ranging in excess of 200 lbs. Centrifuges of this type are used to assess the effects of stress on its payload.

When a centrifuge is used, the centrifuge rotor is driven to extremely high rotational speeds in order to generate the centrifugal field required for research use. A large amount of kinetic energy is built up from the high rotational speeds of the motor. If the kinetic energy is uncontrollably released it can lead to destructive explosion of the centrifuge and injury or damage to its surrounding environment, including the human operator. Centrifuge rotors typically can fail if the rotor is run in excess of the speed designed for its safe operation. The slightest imbalance of the rotor or payload, which it carries, can cause catastrophic failure.

Furthermore, even the slightest imbalance of the rotor or load being carried may grow to larger imbalances, and associated forces, as the rotor speed and centrifugal field increase. Often, these imbalances do not arise until the rotor has achieved very high speeds. The dynamic effect of any imbalancing forces causes complicated movement of the shaft upon which the rotor is suspended, such as dangerous whirls and gyrations. Thus, many systems have been developed to detect such imbalances and are described herein.

The following references generally describe systems and methods for detecting imbalances in centrifugal devices. The references can generally be divided into two groups. The first group either uses a sensor to detect a change in distance between a reference position and a position of the rotor, thereby generating a distance detection signal, or a mechanical switch to shut down the system when it is out of balance.

U.S. Pat. No. 3,422,957 to Fosler describes an unbalanced sensing switch assembly of this first group for centrifugal machines. The system comprises a centrifuge basket coupled to a drive unit by a shaft. A bump switch having a micro-switch component is secured to the outer portion of the shaft. The bump switch assembly is operates to detect unbalances in the load and to shift the drive unit to lower speeds to prevent the unwanted vibrations.

U.S. Pat. No. 4,099,667 to Uchida describes an apparatus for preventing vibration in a centrifugal separator comprising an upright electric motor supported by a resilient member from a machine casing. A mercury type, vibration sensitive, element is used to sense vibrations and open an electric power circuit of the motor.

U.S. Pat. No. 4,214,179 to Jacobson describes a rotor unbalance detector for a centrifuge. The device includes a rotatable electrically conducting ring surrounding a shaft. Washers and an o-ring insulate the electrically conducting ring from the shaft. The shaft is connected to a rotor and chamber. When the rotor chamber becomes unbalanced, the shaft is forced to rotate off its natural axis of rotation. If the axis of rotation differs by a sufficient amount, the shaft will contact the conductive ring, de-energizing the power supplied to the motor and causing it to stop rotating.

U.S. Pat. No. 5,160,876 to Niinai describes a system and method for precisely detecting the unbalance of a rotating body without being adversely affected by external disturbances. Specifically, a rotor is connected to a drive shaft. A displacement sensor is placed in proximity of the drive shaft for detecting the amount of imbalance of the rotor in terms of the vibration amplitude of the rotor. The sensor is connected to an electronic circuit that is in turn connected to a control unit. The control unit contains a microprocessor that performs an arithmetic processing operation according to an algorithm stored therein for calculating a control signal based on the vibration amplitude, derived from the vibration sensor, and time.

The second group of references pertains to unbalance detection systems utilizing an electronic sensor for measuring vibrations or physical stress on the system.

U.S. Pat. No. 54,879,279 to Berger is directed to a centrifugal separator apparatus having a vibration sensor. A dual mode vibration sensor is located radially outward, mounted to the frame of the centrifuge, from a shaft used for rotating a bowl. The vibration sensor is for detecting radial vibrations of the bowl during operation of the centrifuge. Upon the vibration sensor sensing radial vibrations above a first predetermined threshold or a second predetermined threshold, a signal is sent to a controller that activates a D.C. brake or frequency inverter to stop the rotation of the bowl.

Finally, U.S. Pat. No. 5,857,955 to Phillips is directed to a centrifugal control system utilizing a control computer program and a variety of sensors. The computer has several input terminals, two of which are connected to the drive units of the centrifuge. Two output terminals of the computer are used for sending signals to the drive units and to vary the frequency and voltage applied to the AC motors. The variation in the frequency and voltage accordingly varies the rotation and torque applied to the drive shaft. A vibration sensor connected to the outer bowl of the centrifuge sends signals to the computer regarding vibrations associated with the centrifuge. The computer responds to excess vibrations of the centrifuge by generating an output signal causing the drive units to turn off the motors, shutting down the centrifuge.

The above references describe the many attempts to provide an imbalance detection system. While some may work for small-scale centrifuigal systems, adequate detection and control for large centrifuge systems is not possible using the above described systems. Although large centrifuge systems encounter many of the problems of their small-scale counterparts, they also face unique problems that are not addressed by the above references. For example, largescale centrifuges carry payloads in excess of 200 lbs. traveling at speeds in excess of 750 rpms. At these speeds, the payloads are subject to forces in excess of 300 g's, where a "g" is the force of gravity on the object, which is created by the spinning motion of the centrifuge. Furthermore, certain types of testing require instant ramp-ups and -downs of speed of the centrifuge, which cause vibrations resembling imbalances in the payload. The ramp-ups and -downs also place unusual stresses on the centrifuge.

Thus, what is clearly needed to insure centrifuge safety and sample integrity is a system and method of controlling a centrifuge that distinguishes between normal operational vibrations, including vibrations from sudden ramp-ups and -downs, from vibrations caused by true load unbalances. More specifically, a system and method that can detect load unbalances as low as 5 lbs. in a 200-lb. payload, which also allows the user to monitor the imbalance as the centrifuge is operating.

SUMMARY OF THE INVENTION

This invention relates to a system and method for detecting and controlling payload imbalances in centrifuges. In one embodiment, the system consists of an accelerometer sensor attached to a centrifuge enclosure. The system uses an accelerometer in the 0.01–0.02g range for sensing vibrations. The output signal of the sensor is an electrical charge in the form of a sine wave with an amplitude and frequency. The charge is passed through a pre-amplifier to intensify the signal and convert it to a voltage signal. The amplified signal is fed through a low pass filter for removing extraneous vibrations associated with general operation of the centrifuge. The filtered signal is passed through an A/D converter before being fed into a processor for analysis by an algorithm. The algorithm interprets the amplitude and frequency associated with the signal. Once an amplitude threshold has been exceeded, the software algorithm begins to count cycles during a predetermined time period. If a given number of complete cycles occurs during the threshold time period, the system shuts down the centrifuge. The number of cycles over time helps to distinguish between true unbalances and those vibrations caused by sudden ramp-up or -down of the centrifuge, which are transient vibrations. In the event of a true imbalance, typically greater than 5 lbs., the computer sends a signal to a relay or other circuit causing the centrifuge to automatically shutdown. During operation of the centrifuge, the computer automatically displays the relative imbalance value so the operator can immediately tell the condition of the system even before a 5-lb. unbalance occurs.

Some objects of this invention are to:

- provide an imbalance detection system that can measure payload imbalances in centrifuges;
- provide an imbalance detection system that can differentiate between normal vibrations, due to sudden ramp-ups and downs, from vibrations due to payload imbalances; and
- provide a method to detect imbalances and differentiate between normal vibrations, due to ramp-ups and downs, from vibrations due to payload imbalances.

DETAILED DESCRIPTION OF THE DRAWINGS

Figure 1:
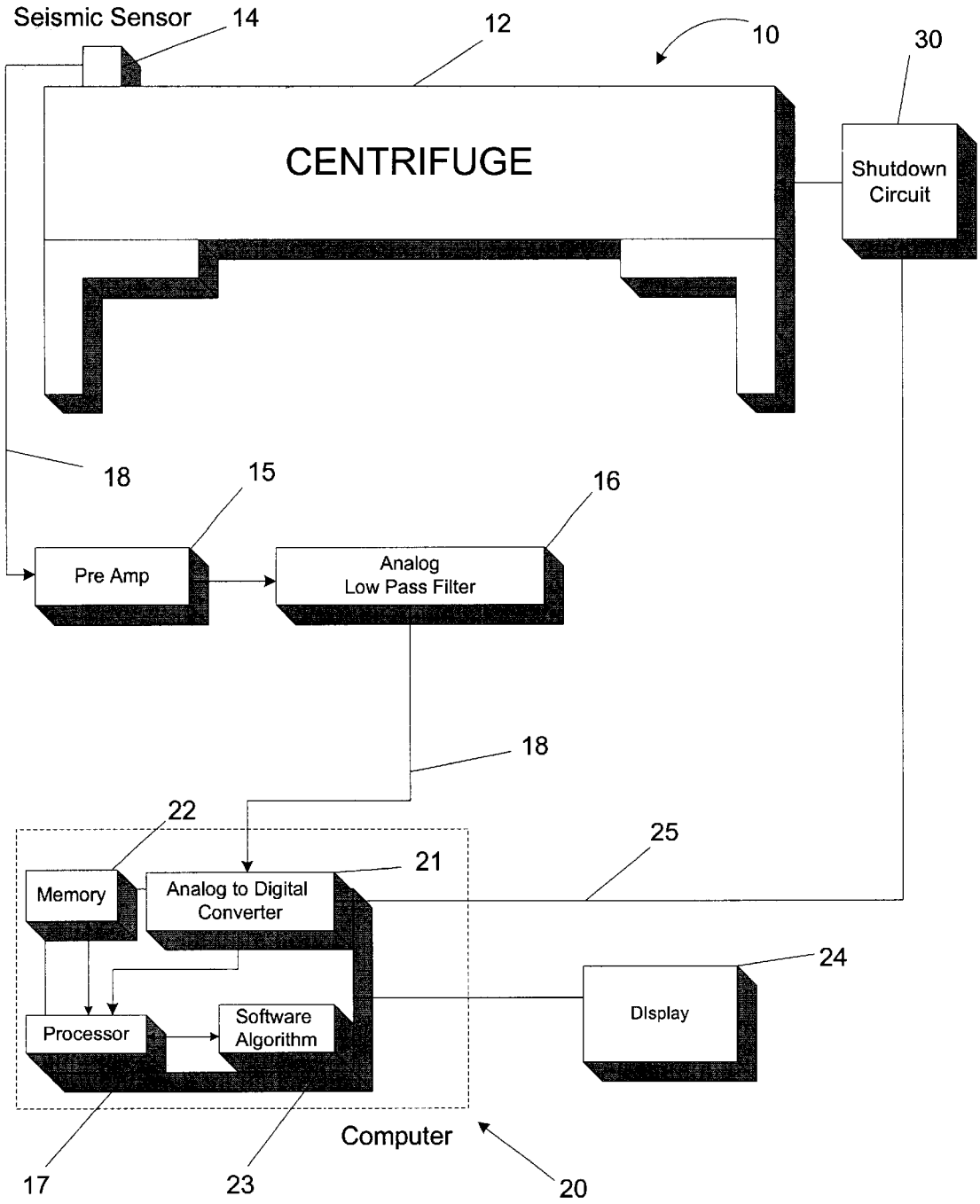
FIG. 1 is a block diagram of an exemplary centrifuge imbalance detection system.
Figure 3:
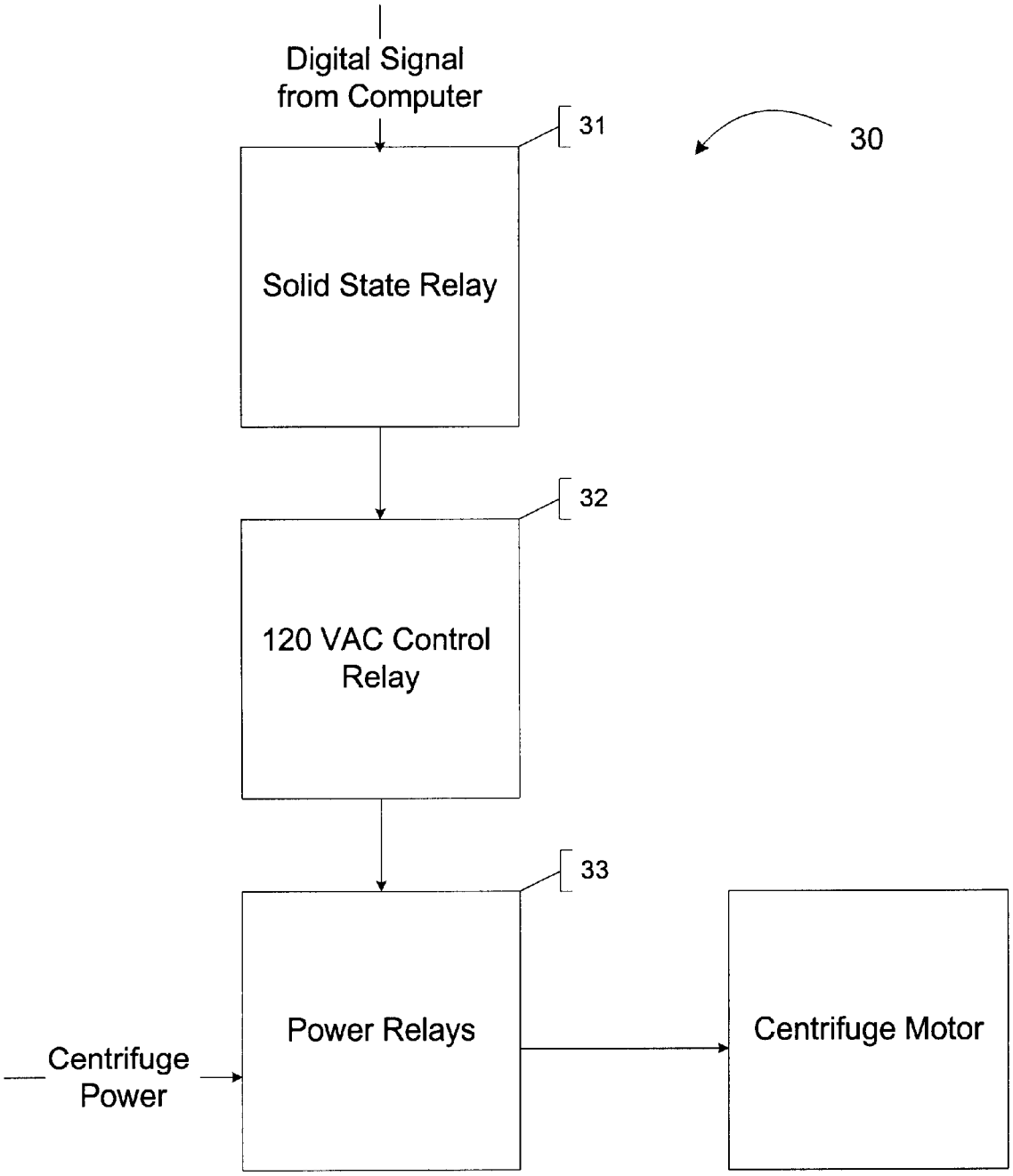
FIG. 3 is a detailed block diagram of the shutdown circuit for the detection system of FIG. 1.

With reference to FIG. 1, there is disclosed a system 10 by which a signal generated by a sensor is used to detect load imbalances in a centrifuge. Detection system 10 includes a centrifuge 12 with a sensor 14 mounted to it. In an embodiment of system 10, the output signal of sensor 14 is passed through a pre-amplifier 15, analog low pass filter 16, and an A/D converter 21 in a detection circuit 20. Detection circuit 20 receives an analog signal through an input/output interface (not shown). Detection circuit 20 in the preferred embodiment is a computer having a processor 17, memory 22, first input/output interface for receiving the analog signal, A/D converter 21, a second input/output interface (not shown) for receiving input data, for example from a keyboard, a third input/output interface (not shown) for displaying data on a display 24, and a fourth input/output interface (not shown) for supplying a signal to a shutdown circuit 30 (FIGS. 1 and 3).

Centrifuge 12 is of the kind used for evaluating forces on heavy objects, which can exceed weights of several hundred pounds. However, detection system 10 can work equally well on small-scale centrifuge systems. Because centrifuge 12 carries heavy payloads that cause large radial forces during operation, centrifuge 12 must be bolted down to a floor surface to stabilize it during operation. Therefore, the vibration-sensing device must be sensitive enough to detect vibrations not readily detectable from visual physical movement of centrifuge 12.

Detection system 10 utilizes a sensor 14 that is mounted to centrifuge 12 so that sensor 14 can detect seismic activity caused by load imbalances. Sensor 14 may be a standard motion detector accelerometer and provides an output charge signal on line 18 representative of the mechanical motion experienced by centrifuge 12. Sensor 14 is preferably an Endevco Isotron Accelerometer Model 7754-100 that measures in the 0.01 g range. Sensor 14 is positioned in the drive mechanism of centrifuge 12 for the maximum detection of motion of centrifuge 12 during operation. Sensor 14 generates an electrical signal, 1000 mV per g force, in the form of a sine wave having a negative and positive amplitude and frequency. The negative and positive amplitude of the sine wave is proportional to the vibration caused by imbalances, and the frequency of the wave represents the repetitive nature of the vibration.

The voltage on line 18 is passed through pre-amp 15, which amplifies the signal. Preferably, pre-amp 15 is an Endevco Model 4416B with a gain setting equal to ten. The voltage signal is then passed through an analog low pass filter 16, which effectively removes all frequencies above 10 Hz. Preferably, low pass filter 16 is a 5 Hz Frequency Devices Model# 900C/9L8B having a unity gain. Once the signal has been amplified and filtered, the signal is passed through A/D converter 21, located in detection circuit 20, which converts the analog signal to a digital signal. The digital signal is then operated on by algorithm 23 resident on memory 22.

Detection circuit 20 is preferably a computer having a processor 17, memory 22, A/D converter board 21 and algorithm 23. Prior to operation of centrifuge 12, an operator can input threshold values into detection circuit 20 through the use of a keyboard (not shown). Alternatively, the threshold values may be preprogrammed in detection algorithm 23. The threshold values include maximum amplitude and frequency values, which may be supplied by the user, are used by algorithm 23 for detecting load imbalances. The acceptable threshold values may be based on actual calibration with an imbalanced load. The digital signal from A/D converter 21 is supplied to processor 17, which accepts the digital signal. Processor 17 is a high speed, high performance, and low cost processor such as a conventional microprocessor found in an ordinary computer, capable of receiving and processing digital signals. Processor 17 also produces an output signal on line 25 that is used to control a shutdown circuit 30.

Figure 2:
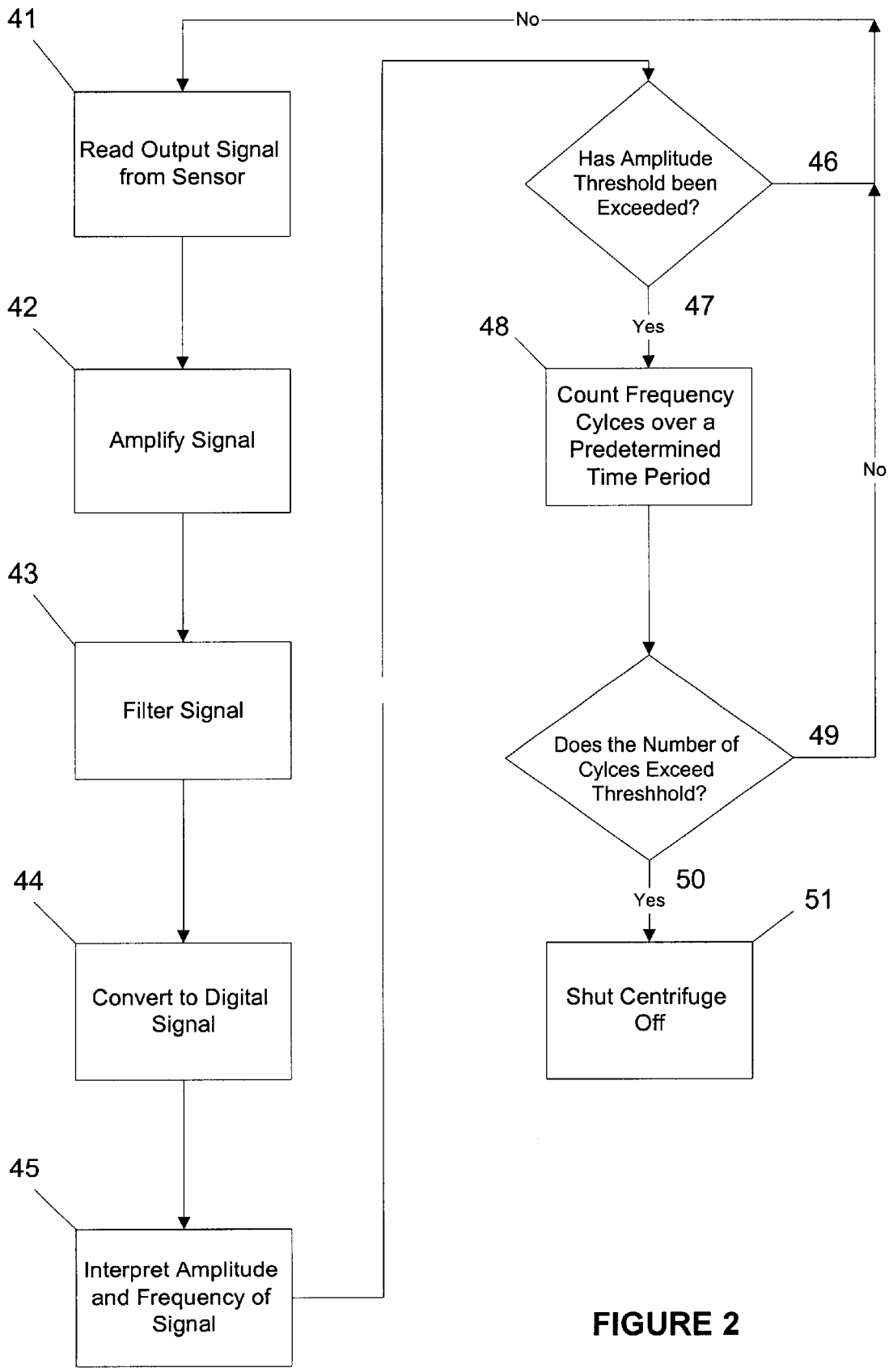
FIG. 2 is a functional block diagram of the exemplary centrifuge unbalance detection system of FIG. 1.

The determination of an unbalanced condition is carried out by detection algorithm 23 in accordance with the process of FIG. 2. In step 41, sensor 14 detects a vibration in centrifuge 12 and produces a voltage signal containing magnitude and frequency data of 1000 mV per 1 g force. In 42, the signal is amplified and converted to a voltage before being filtered 43. The filtering process removes extraneous noise with frequency greater than 10 Hz, which is associated with vibrations from the sudden ramp-ups and -downs and other normal operational vibrations. After filtering the signal, the analog signal is digitized 44 and passed to the processor in detection circuit 20. In 45, algorithm 23 operates on the digital signal by interpreting the amplitude and frequency. The first step is comparing the amplitude of the signal to the pre-established threshold value. If the amplitude does not exceed the threshold value in a positive and negative direction typically within a fraction of a second 46, the algorithm reads the next sample. However, if the threshold value is exceeded in the positive and negative direction 47, the algorithm counts the frequency 48 of the vibration over a predetermined time period, for example, three complete cycles within three seconds. If the algorithm does not detect three complete cycles within a few seconds 49, a new signal is read from the sensor 41. Otherwise, if three complete cycles are detected 50, algorithm 23 turns on a digital output signal 51 to shutdown circuit 30, which causes the power to be disengaged from centrifuge 12.

Shutdown circuit 30, in FIG. 3, may consist of a solid state relay 31, control relay and power relays 33. When the digital shutdown signal is generated from detection circuit 20, the signal trips the relays causing the power to be disengaged from the motor of centrifuge 12. Upon shutdown, the centrifuge operator can re-adjust the payload to remove the imbalance.

During operation of centrifuge 12, algorithm 23 continually monitors the signal from sensor 14. As the signal is being monitored and operated on by algorithm 23, the detection circuit 20 automatically displays the relative imbalance value on display 24 so the operator can immediately tell the condition of the centrifuge even before a threshold imbalance occurs.

The forgoing is provided for purposes of illustrating, explaining, and describing embodiments of the present invention, an imbalance detection system and method for detecting load imbalances in centrifuges. Modifications and adaptations to these embodiments will be apparent to those skilled in the art and may be made without departing from the spirit of the invention or the scope of the following claims.

What is claimed:

1. A method for detecting load unbalances in large-scale centrifuges, the method comprising:

a. detecting a vibration through a signal from a sensor that is mounted on the centrifuge and senses vibrations;

b. filtering the signal from the sensor to remove noise caused by normal operational vibrations;

c. interpreting the amplitude and frequency of the filtered signal using an algorithm;

d. counting the frequency cycles of the vibration when the amplitude of the signal exceeds a first threshold value; and e. shutting down the centrifuge if the number of frequency cycles during a predetermined time period exceeds a second threshold value.

2. The method of claim 1, further comprising programming the threshold values in the algorithm.

3. The method of claim 1, further comprising the inputting of the threshold values in the algorithm through the use of a first input/output interface.

4. The method of claim 1, further comprising displaying the load imbalance detected on a display so the operator can monitor the load imbalance during operation of the centrifuge.

5. The method of claim 1, wherein the filtering removes noise frequencies above 10 Hz.

6. The method of claim 1, wherein shutting down the centrifuge occurs if three frequency cycles occur within the predetermined time period.

7. The method of claim 1, wherein interpreting the amplitude further comprises comparing the positive and negative amplitude of the signal to the first threshold value and if the absolute value of the negative and positive amplitude both exceed the first threshold value, the algorithm begins counting the frequency cycles.

8. The method of claim 7, wherein shutting down the centrifuge occurs if three frequency cycles are counted within the predetermined time period.

9. A system for detecting load imbalances in large-scale centrifuges, comprising:

a. a sensor mounted to the centrifuge for generating a signal relating to the magnitude and frequency of a load imbalance;

b. a processor for receiving the signal of the sensor;

c. a shutdown circuit; and d. an imbalance detection algorithm that operates on the processor by comparing the amplitude of the signal to a selected amplitude threshold value and if the amplitude threshold value is exceeded, by counting the number of frequency cycles in the signal and if the number of cycles exceeds a selected frequency threshold value, engaging the shutdown circuit to shutdown the centrifuge.

10. The system of claim 9, further comprising a display whereby the load imbalance is displayed as the centrifuge is operating.

11. The system of claim 9, further comprising a pre-amplifier for amplifying the signal from the sensor.

12. The system of claim 11, wherein the pre amp has a gain of 10 decibels.

13. The system of claim 11, further comprising a low pass filter for filtering the amplified signal.

14. The system of claim 13, wherein the low pass filter has a 10 Hz upper cutoff frequency and unity gain.

15. The system of claim 13, further comprising an A/D converter for digitizing the filtered signal.

16. The system of claim 9, wherein the selected frequency threshold value is three complete cycles.

* * * * *